US005947704A

United States Patent [19]

Hsieh

[11] Patent Number: 5,947,704

[45] Date of Patent: Sep. 7, 1999

[54] FAN ASSEMBLY

[76] Inventor: Hsin-Mao Hsieh, No. 6, East Section, Chiao Nan Li,Industrial 6th Rd., Pingtung City, Pingtung Hsien, Taiwan

[21] Appl. No.: 08/941,333

[22] Filed: Sep. 30, 1997

[51] Int. Cl.[6] ..... F04B 17/02

[52] U.S. Cl. ..... 417/423.12; 417/423.14

[58] Field of Search ..... 417/354, 42, 423.1, 417/423.12, 423.14

[56] References Cited

U.S. PATENT DOCUMENTS 4,130,374 12/1978 Bingler ..... 415/131

4,801,252 1/1989 Wrobel ..... 417/354

5,059,092 10/1991 Troller et al. ..... 417/368

*Primary Examiner*—Charles G. Freay

*Assistant Examiner*—Robert Z. Evora

*Attorney, Agent, or Firm*—William E. Pelton, Esq.

[57] ABSTRACT

A fan assembly includes a housing into which a base is disposed, the base having a tubular portion extending therefrom from which a projection extends, a motor mounted to the tubular portion, a bearing mounted to the projection and a fan blade device having a central hole defined therein so that the bearing is securely engaged with a periphery defining the central hole.

3 Claims, 3 Drawing Sheets

FAN ASSEMBLY

BACKGROUND OF THE INVENTION

1. Field of the Invention

The present invention relates to a fan assembly and, more particularly, to a direct current (DC) fan assembly disposed in an electrical product to remove heat from an interior thereof.

2. Brief Description of the Prior Art

FIG. 3 shows a conventional fan assembly disposed in an electrical product such as a computer, a camera or the like, so as to reduce high temperature caused by an operation of electrical parts in the electrical product. The fan assembly is required to be operated silently and efficiently, and is generally operated at a high speed for a long period of time. As shown, the fan assembly includes a housing 40 having a base 41 disposed therein which has a tubular portion 42 extending upwardly therefrom through which a passage 411 is defined, a motor mounted to the tubular portion 42, and a fan blade device 50 rotatably mounted to the motor with two bearings 60 disposed between a shaft 51 and an inner periphery defining the passage 411. The motor has a motor casing 73 and a rubber magnet 72 disposed to an inner periphery of the motor casing 73, a stator 70 mounted to the tubular portion 42 and an integrated circuit board 71 mounted to the tubular portion 42 with a support 74 disposed between the stator 70 and the board 71. A flange 412 extends inwardly and radially from the inner periphery defining the passage 411 so that the fan blade device 50 is mounted to the motor casing 73 and the shaft 51 thereof rotatably extends through a hole 4120 defined by an outer periphery of the flange 412. The two bearings 60 are respectively disposed on and under the flange 412. It is to be noted that the two bearings 60 are expensive and which are respectively mounted to the shaft 51 so that a precise concentricity amount for the hole, the two bearings 60 and the shaft 51 is highly required.

The present invention intends to provide an improved fan assembly to mitigate and/or obviate the above-mentioned problems.

SUMMARY OF THE INVENTION

The present invention provides a fan assembly which includes a base having a tubular portion extending therefrom from which a projection extends to which a bearing is securely mounted. A motor is mounted to the tubular portion. A fan blade device has a central hole defined therein so that the bearing is securely engaged with a periphery defining the central hole.

It is an object of the present invention to provide a fan device having a simple structure.

It is another object of the present invention to provide a fan device which has no shaft.

It is a further object of the present invention to provide a fan assembly using only one bearing.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
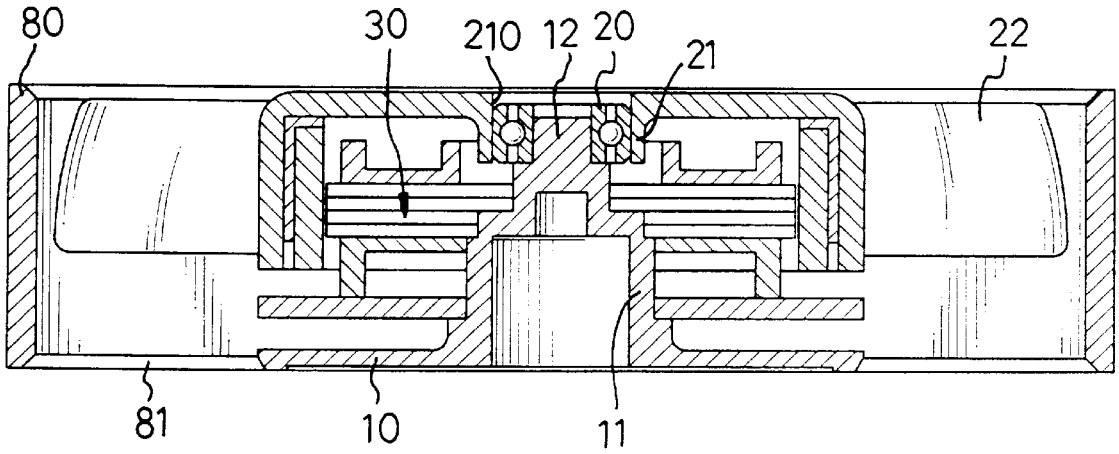
FIG. 1 is a side elevational view, partly in section, of a fan assembly in accordance with the present invention.
Figure 3:
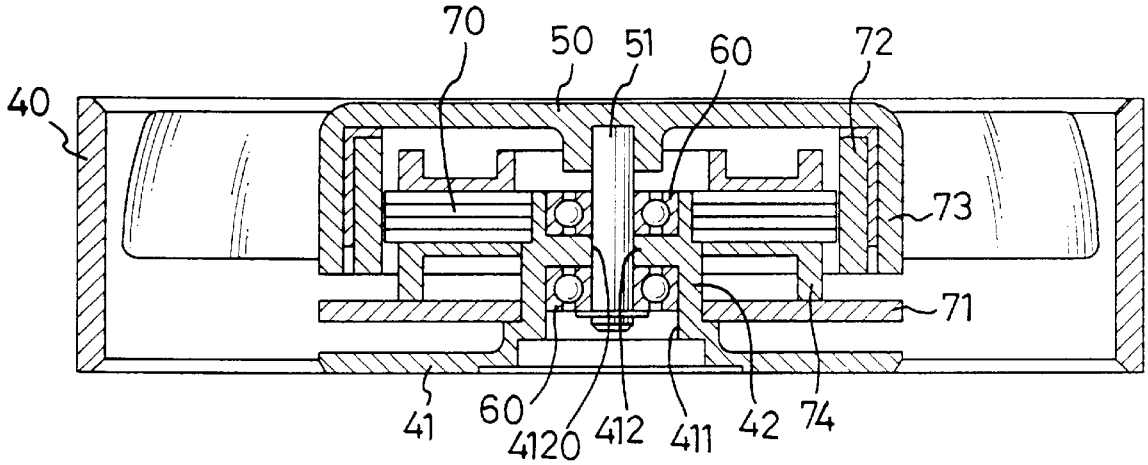
FIG.3 PRIOR ART
FIG. 3 is a side elevational view, partly in section, of a conventional fan device.

Referring to FIG. 1, a fan assembly in accordance with the present invention generally includes a housing 80 and a base 10 fixedly disposed to a bottom 81 thereof wherein the base 10 has a tubular portion 11 extending therefrom and from which a projection 12 extends which has an outer diameter smaller than that of the tubular portion 11. A bearing 20 is securely mounted to the projection 12. A motor 30 which is conventional and has the same structure as that shown in FIG. 3, is mounted to the tubular portion 11.

A fan blade device has a central part 21 from which a plurality of blades 22 extend, and a central hole 210 defined through a central portion 21 of the fan blade device. The bearing 20 is securely engaged with a periphery defining the central hole 21 of the fan blade device 21.

Accordingly, the fan assembly of the present invention provides the fan blade device without a shaft and uses only one bearing 20 so that any problem about eccentricity which may cause fouling between components is easily controlled. Also, it is much easier to assemble the fan which is composed of fewer parts.

Figure 2:
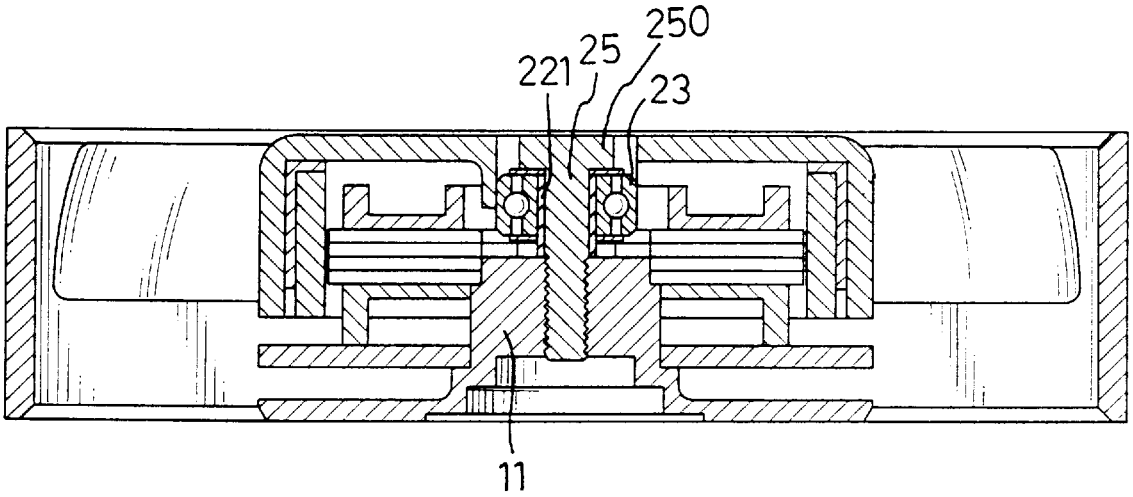
FIG. 2 is a side elevational view, partly in section, of a second embodiment of the fan assembly of the present invention.

FIG. 2 shows a second embodiment of the present invention wherein the projection 12 as shown in FIG. 1 is replaced by a bolt 25 which is threadedly inserted into the tubular portion 11 and has a head 250 extending radially and outwardly from a top thereof. A bearing 23 is disposed between the head 250 and the tubular portion 11. A bush 221 is inserted between the bolt 25 and the bearing 23. A fan blade assembly as shown in FIG. 1 is mounted to the bearing 23.

Although the invention has been explained in relation to its preferred embodiment, it is to be understood that many other possible modifications and variations can be made without departing from the spirit and scope of the invention as hereinafter claimed.

What is claimed is:

1. A fan assembly comprising:

a base having a tubular portion extending therefrom, a projection extending from said tubular portion and a bearing mounted to said projection;

a motor mounted to said tubular portion, and a fan blade device having a central hole defined therein so that said bearing is securely engaged with an inner surface of said blade device defining said central hole.

2. The fan assembly as claimed in claim 1 wherein said projection is a bolt.

3. The fan assembly as claimed in claim 1 wherein said bolt is threadedly inserted into said tubular portion and has a head extending radially and outwardly from a top thereof so that said bearing is disposed between said head and said tubular portion.

* * * * *